United States Patent [19]

Engkvist

[11] 4,355,476

[45] Oct. 26, 1982

[54] BUCKET ASSEMBLY

[75] Inventor: Lars G. Engkvist, Kilafors, Sweden

[73] Assignee: Soneruds Maskin Aktiebolag, Hudiksvall, Sweden

[21] Appl. No.: 202,441

[22] PCT Filed: Jan. 3, 1980

[86] PCT No.: PCT/SE80/00001

§ 371 Date: Sep. 3, 1980

§ 102(e) Date: Sep. 3, 1980

[87] PCT Pub. No.: WO80/01393

PCT Pub. Date: Jul. 10, 1980

[30] Foreign Application Priority Data

Jan. 3, 1979 [SE] Sweden ..... 79000040

[51] Int. Cl.[3] ..... E02F 3/76

[52] U.S. Cl. ..... 37/117.5; 37/103; 37/DIG. 3

[58] Field of Search ..... 37/117.5, 103, DIG. 3, 37/2 R, 115, 116, 118

[56] References Cited

U.S. PATENT DOCUMENTS

| | | | |
|---|---|---|---|
| 2,387,656 | 10/1945 | Gledhill | 37/117.5 |
| 3,057,599 | 10/1962 | Clatterbuck | 37/2 R X |
| 3,116,048 | 12/1963 | Irwin et al. | 37/2 R X |
| 3,323,234 | 6/1967 | Pickrell | 37/103 |
| 3,702,712 | 11/1972 | Cairns | 37/117.5 X |
| 3,739,823 | 6/1973 | Bartell | 37/2 R |
| 3,997,068 | 12/1976 | Lock | 37/117.5 |
| 4,070,772 | 1/1978 | Motomura et al. | 37/117.5 |
| 4,204,348 | 5/1980 | Lydie | 37/117.5 |

FOREIGN PATENT DOCUMENTS

| | | | |
|---|---|---|---|
| 605714 | 9/1960 | Canada | 37/2 R |
| 1456439 | 6/1975 | Fed. Rep. of Germany | 37/DIG. 3 |
| 2153304 | 5/1973 | France | 37/DIG. 3 |
| 2226513 | 11/1974 | France | 37/DIG. 3 |
| 7714027 | 7/1979 | Sweden | 37/2 R |
| 880567 | 10/1961 | United Kingdom | 37/2 R |
| 1070877 | 7/1967 | United Kingdom | 37/DIG. 3 |
| 1095250 | 12/1967 | United Kingdom | 37/DIG. 3 |
| 1106021 | 3/1968 | United Kingdom | 37/DIG. 3 |
| 1374859 | 11/1974 | United Kingdom | 37/DIG. 3 |
| 293941 | 3/1971 | U.S.S.R. | 37/117.5 |
| 534552 | 2/1977 | U.S.S.R. | 37/103 |

*Primary Examiner*—E. H. Eickholt

*Attorney, Agent, or Firm*—Oblon, Fisher, Spivak, McClelland & Maier

[57] ABSTRACT

The invention relates to a bucket intended for excavators or loading machines, said bucket having a gripping tool arranged to grip and hold objects such as light or cable poles in order to raise the poles. The tool comprises two claws which are built into a special box in the bucket and which are hydraulically controlled from the machine itself.

9 Claims, 3 Drawing Figures

BUCKET ASSEMBLY

TECHNICAL FIELD

This invention relates to a bucket assembly for excavators or loaders, comprising, in addition to a bucket portion, a gripping tool arranged to grip, as needed, arbitrary objects such as poles, pillars, beams or the like and hold them in relation to the bucket.

BACKGROUND ART

A bucket assembly of this type solely intended for loaders is previously known by the British Pat. No. 1,070,877 which discloses a gripping tool having two claws or claw-like arms which are mounted for pivoting movements towards and away from each other while forming a jaw of variable size for receiving the object. These two claw arms are comparatively long and mounted directly upon the top surface of the bucket portion in such a way that a large portion of each arm always juts out from the upper edge of the bucket portion. In practice this means that the bucket assembly cannot be used for digging purposes since the claw arms forming the gripping tool would, due to the existance of the long, jutting arm portions, obstruct pivoting of the bucket portion to a normal starting position for digging and, due to the placing of the arms directly on the top surface of the bucket portion, preclude a connection of the assembly to the digging arms which are customary for excavators. The arms would also be subjected to considerable wear and strains because they lie quite unprotected on the outside of the bucket portion.

DISCLOSURE OF INVENTION

The present invention aims at eliminating the above mentioned limitations in the bucket assembly previously known and rendering the same all-round more useful while increasing the working life thereof at the same time. In accordance with the characterizing features of the invention this is achieved by the fact that the gripping tool is built into a suitably box-like protective housing into which the tool, through an opening, may be inserted to an inactive, protected position permitting the use of the bucket assembly for digging purposes without hindrance of the gripping tool and out of which the tool may be brought to an active position in which it is capable of gripping said objects. By arranging the gripping tool in this way the bucket assembly may with particularly great advantage first of all be used for digging a pit in the ground and immediately thereafter grip a telephone or cable pole and place the same in the dug pit.

FURTHER DIFFERENCES BETWEEN THE INVENTION AND THE PRIOR ART

Furthermore the bucket assembly according to the British patent specification mentioned relies on the use of two separate piston-cylinder mechanisms for controlling the two claws or arms which jointly form the gripping tool. This construction is unsatisfactory in so far as the claws will move non-uniformly if one of the mechanisms binds or otherwise moves in a manner differing from the manner in which the other mechanism moves; which in turn means that the object which is held by the claws is not centered in relation to the bucket. Rather, the object may on one occasion move to the left and on the other occasion to the right in relation to the center of the bucket; involving working conditions which are difficult to master for the operator who, when it is a question of for instance mounting of telephone poles in ground pits dug by means of the bucket, is dependent on a precise alignment of the pole in the dug mark pit. In order to eliminate this drawback the invention proposes that the claws, through suitable connecting means, are connected to a control mechanism common to both of the claws, said mechanism in operation always transmitting substantially uniform control movements to the two claws while assuring an automatic centration of an object being present therebetween.

In the structure according to the British patent specification there is also a risk that the pole, especially if it is of a considerable length, will rotate or pivot relative to the place of gripping of the claws around the pole since the two claws are movable towards and away from each other in one and the same plane. In connection with the invention this risk is eliminated by the fact that at least one of the two claws comprises two members or halves which are spaced in the direction parallel to the pivot axis of the claw and between which the other claw may be wholly or partially inserted upon pivoting the claws inwardly towards each other.

BRIEF DESCRIPTION OF DRAWINGS

With reference to the attached drawings a closer description of an embodiment of the invention put forward as an example will follow hereinafter. In the drawings

BEST MODE FOR CARRYING OUT THE INVENTION

Figure 1:
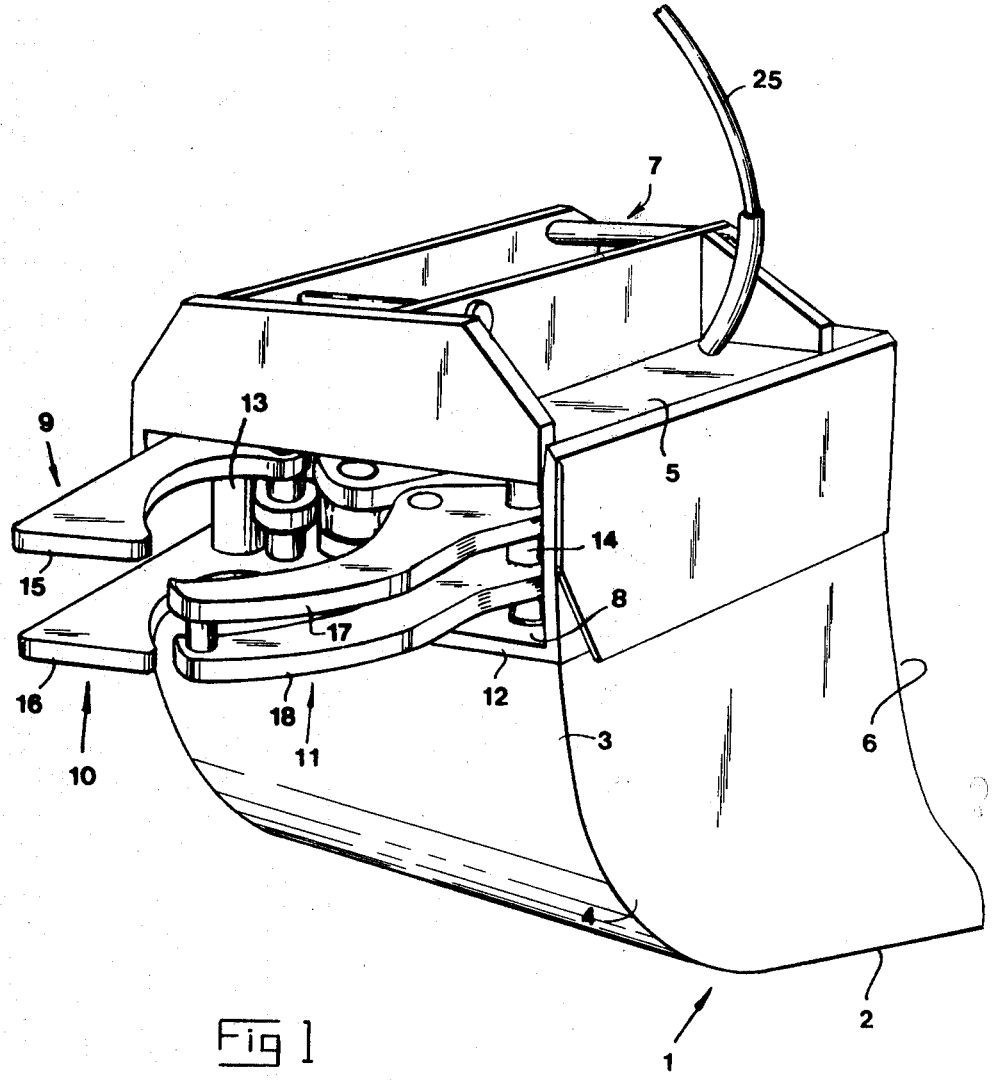
FIG. 1 is a partially simplified perspective view of a bucket assembly according to the invention as viewed obliquely from the front, FIG. 2 a horizontal section through the assembly of FIG. 1 the gripping tool in question being shown in its inactive position and FIG. 3 a similar section showing the gripping tool in the active position.

A bucket for an excavator is generally designated 1 in FIG. 1. In the conventional manner the bucket is designed with a bottom piece 2 extending obliquely upwardly-forwardly, a front piece 3, two side pieces 4 and a top piece 5. In the back, the bucket has a mouth designated 6 which is not visible in the drawing. The bucket has an attachment generally designated 7 which in a suitable manner may be connected to the free end of the arm of the excavator (not shown) in relation to which the bucket is pivotable in the usual manner.

The bucket or bucket portion 1 comprises a gripping tool generally designated 9 which in the example shown consists of two claws 10, 11 which are hingedly mounted relative to the bucket and which are pivotable towards and away from each other while forming a jaw of variable size. More precisely the gripping tool 9 is located in the upper part of the bucket 1 with the gripping claws 10, 11 directed substantially forwardly from the bucket, or in other words directed substantially diametrically opposed to the above-mentioned mouth 6 in the bucket.

According to the invention the gripping tool 9 is built into a protective housing in the form of a box 12 which may be mounted as a unit in or on the bucket. The bucket may either be a bucket which is already manufactured and in use or a newly-produced bucket. In the former case there are two alternative possibilities of mounting the box 12 to the bucket. Either the box is inserted in the interior of the bucket, a suitable portion of the front piece being cut away in order to permit extension of the claws 10, 11, or is the above-mentioned attachment 7 is cut away from the bucket, whereupon the box 12, preferably by welding, is attached to the upper surface of the top piece of the bucket, whereupon the attachment 7 is finally fixed on top of the box proper. In the latter case one achieves the advantage that the box does not encroach on the effective volume of the bucket. As best seen from FIG. 2 the box 12 is completely closed except for the opening designated 8 through which the two claws 10, 11 forming the tool 9 are movable between their active and inactive positions respectively.

In FIG. 1 it is shown how the two claws 10, 11 are pivotable each about a vertical hinge or shaft 13 and 14 respectively extending between the top and the bottom of the box 12, said shafts suitably being easy to dismount, e.g. by means of Seeger-rings (not shown). Furthermore it appears how the claw 10 comprises two members or halves 15, 16 which are rather distantly spaced along the shaft 13 and between which the other claw 11 may in its entirety be inserted upon pivoting the claws towards each other. In the embodiment shown, the claw 11 is composed of two interspaced members 17, 18, which give a good gripping and holding capability in connection with long objects which are located between the claws parallel to the shafts 13, 14.

Figure 2:
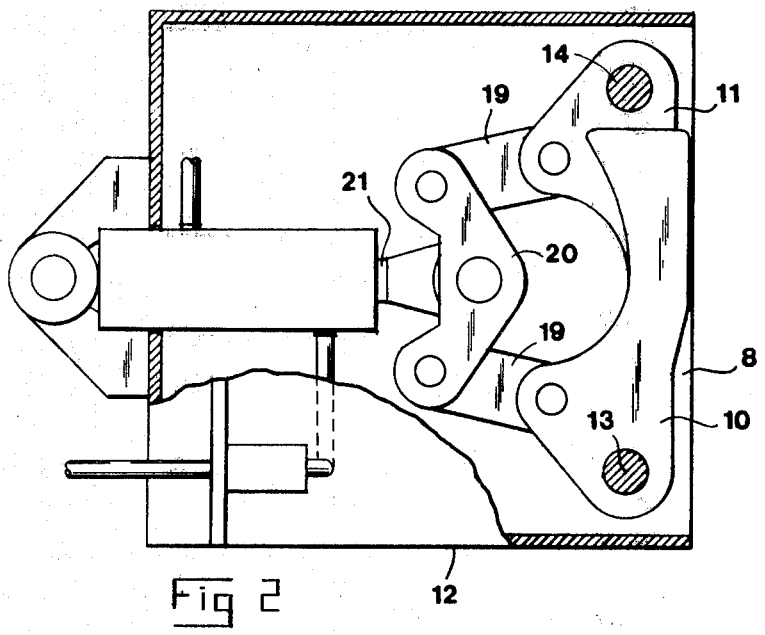
Figure 3:
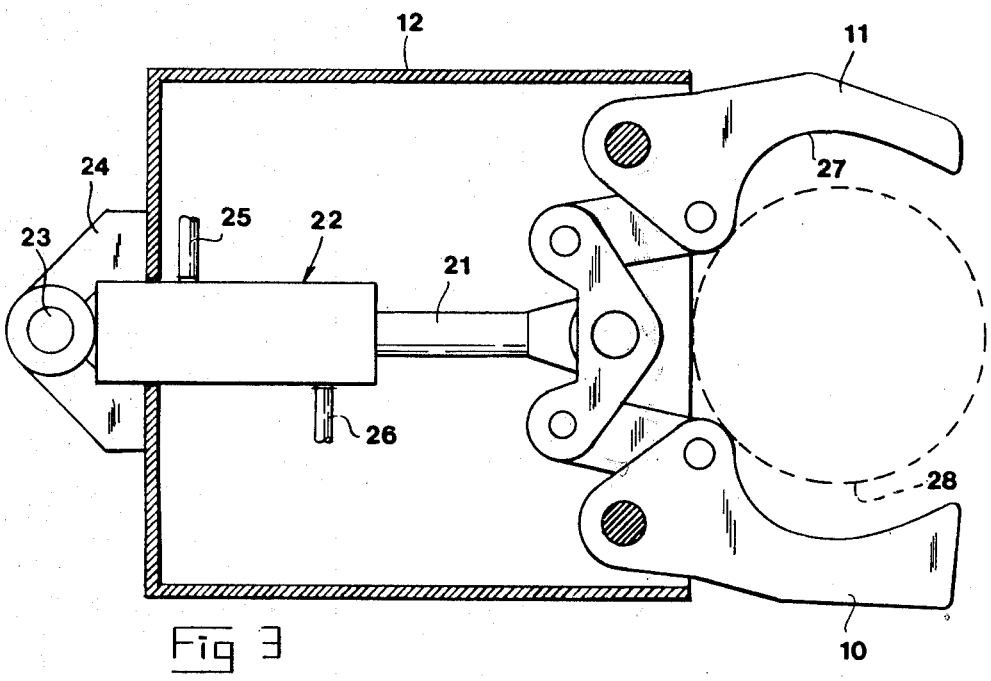

From FIGS. 2 and 3 it may be seen how the claws 10, 11 are hingedly connected to links 19 which in turn are hingedly connected to a yoke 20 being common to both of the claws. This yoke in turn is again hingedly connected to the free end of the piston rod 21 of a hydraulic piston-cylinder mechanism, designated 22, of the double-acting type. At the end being remote from the piston rod 21 this piston-cylinder mechanism is hingedly suspended to a third fixed hinge shaft 23 which in the example shown is fixed in a special fastener 24 projecting from the box 12. By two hydraulic conduits 25, 26 (of which only the first mentioned one is visible in FIG. 1) the cylinder of the mechanism 22 is connected to the hydraulic system or the power source of the excavator in question. In this way the piston-cylinder mechanism and thereby the gripping tool 9 may be controlled from the driving compartment of the excavator.

From FIG. 3 it is seen that the gripping surfaces 27 of the claws or claw members are of arcuate shape having a gradually increasing radius in the direction of the free ends of the claws. In this way one obtains a favourable grip of objects 28, e.g. poles, having highly varying sectional sizes.

It should also be pointed out that the piston-cylinder mechanism 22 may, in the conventional manner, be advantageously equipped with so called hose breakage valves, i.e. safety valves which guarantee that the piston rod 21 remains in a settled position in which the gripping tool maintains its grip of the object in question even in the event of breakage or leakage occuring in anyone of the conduits 25, 26.

FUNCTION

The bucket described operates in the following way. When the bucket 1 is used for its proper purpose, i.e. digging, the claws 10, 11 are kept inserted in the interior of the bucket or the box 12 in the inactive position shown in FIG. 2. In this condition the claws do not form any obstacle whatsoever for the bucket during the digging work thereof. The insertion of the claws is assured by the fact that the piston rod 21 is pushed into its innermost position and through the yoke 20 and the links 19 this movement causes the claws to pivot about their respective shafts 13, 14 to the positions shown in FIG. 2. As soon as the need arises to grip an object, e.g. a light pole or a cable pole after finishing the digging of a pit for the pole, the claws 10, 11 may be activated by pushing the piston rod out of its cylinder while extending the claws out of the shell-like exterior of the bucket to the position shown in FIG. 3. After this the object or pole 28 may be gripped between the claws 10, 11 by the piston rod 21 again being pulled into the cylinder which will have the result that the claws are pivoted and caused to contact the pole 28 while fastening the pole in the jaw formed by the claws. As indicated in FIG. 3 the pole 28 will also contact and abut the front portion of the bucket assembly or more precisely abut the elements which confine the front opening 8 of the protective box 12. In this condition the pole may easily be raised by pivoting or rotating the entire bucket relative to the excavator arm in a manner known per se until the pole has assumed a vertical position in which it is retained during the anchoring work.

POSSIBLE MODIFICATIONS

Of course the invention is not limited merely to the embodiment described and shown in the drawings. Thus the assembly of the invention is useful not only in connection with excavators per se but also in connection with, for instance, loading machines using buckets. Further the invention may be used for gripping other objects than light poles, e.g. pillars, beams, plates or other things. The gripping tool may also have another design than the tool shown. Thus it is conceivable to give the claws 10 and 11 such a shape that they will together in their inserted, inactive condition substantially completely fill up the opening 8 in the box while forming an efficient obstacle to the penetration of dirt into the interior of the box during the digging work. In another modification it is possible to direct the piston-cylinder mechanism 22 so as to locate the fixed hinge shaft 23 thereof in the vicinity of the open end of the box 12 while the yoke 20 is located at the closed end of the box, the connection of the gripping claws 10, 11 to the yoke 20 being carried out through links which are considerably longer than the links 19 shown in the drawings and which extend substantially parallel to the cylinder 22.

What is claimed as new and desired to be secured by Letters Patent of the United States is:

1. A bucket assembly for excavators or loaders, comprising:

a bucket having walls defining a volume, and an opening coplanar with one of said walls; and a gripping tool adapted to be movable between two positions, the first of said positions being entirely within said volume defined by said walls, and the second of said positions extending partially out of said volume through said opening.

2. The bucket assembly of claim 1 wherein said gripping tool is adapted to grip an object in said second position in which said one of said walls is adapted to form an abutment for said gripped object.

3. The bucket assembly of claim 1 wherein said volume is a box-like housing.

4. The bucket assembly of claim 3 wherein said bucket has a mouth in a second of said walls opposite said one of said walls.

5. The bucket assembly of claim 1 wherein said gripping tool comprises:

a central control mechanism;

two claws pivotally mounted for movement toward and away from each other; and connecting means connecting said control mechanism to said two claws, whereby the closing of said claws centers objects positioned therebetween.

6. The bucket assembly of claim 5 wherein said central control mechanism comprises a piston movable in a cylinder, and wherein said connecting means comprise a yoke fixed to said piston and links pivotally connected between said yoke and each said claw.

7. The bucket assembly of claims 5 or 6 wherein said pivotal mounting of said claws comprise pivot shafts extending between the top and bottom walls of a box-like housing in said volume, said pivot shafts extending through said claws, and wherein said cylinder is pivotally mounted to said housing.

8. The bucket assembly of claim 5 wherein at least one of said claws comprises two portions spaced along the axis of said pivotal mounting and wherein said two claws are mutually spaced along the axis of said pivotal mounting such that each of said two claws are intersected by a vertical line intersecting a portion of the other said claws, when said claws are in said first position.

9. The bucket assembly of claim 5 wherein the gripping surfaces of said claws are arcuate and have a gradually increasing radius in the direction of the distal ends of said claws.

* * * * *